US005924964A

United States Patent [19]

Hayden

[11] Patent Number: 5,924,964

[45] Date of Patent: Jul. 20, 1999

[54] HORIZONTALLY EXTENDIBLE DUMBBELL SUPPORT ATTACHMENT FOR WEIGHT LIFTING BENCH

[75] Inventor: Richard C. Hayden, 1576 Heatherwood Dr., Decatur, Ga. 30033

[73] Assignee: Richard C. Hayden, Decatur, Ga.

[21] Appl. No.: 09/018,453

[22] Filed: Feb. 4, 1998

Related U.S. Application Data

[63] Continuation-in-part of application No. 08/829,331, Mar. 31, 1997.

[51] Int. Cl.[6] ..... A63B 21/78

[52] U.S. Cl. ..... 482/104; 482/94; 482/142

[58] Field of Search ..... 482/104, 94, 142, 482/137, 908, 108, 106

[56] References Cited

U.S. PATENT DOCUMENTS

| | | | |
|---|---|---|---|
| 5,250,013 | 10/1993 | Brangi | 482/908 |
| 5,472,397 | 12/1995 | Ammoscato et al. | 482/104 |
| 5,725,460 | 3/1998 | Marsh | 482/104 |

*Primary Examiner*—Jerome Donnelly

*Attorney, Agent, or Firm*—Harry I. Leon; Vivian L. Steadman

[57] ABSTRACT

An attachment which can be mounted on popular weight lifting exercise equipment, to facilitate workouts using hand-held weights commonly referred to as dumbbells. The attachment comprises a rack assembly on which an athlete can support up to two dumbbells simultaneously. Readily adaptable for use with any weight lifting bench, the attachment includes a pair of mounting legs rigidly attached to distal ends of the rack assembly and an extension bar slideably connected to opposing parts of this assembly for adjusting the span between these mounting legs. By utilizing the span adjusting means, one can align the mounting legs with the weight support columns of any particular weight lifting bench even though the spacing between these columns may differ substantially from that of other benches. Moreover, the rack assembly is attached to the mounting legs in such a way that when a dumbbell rests on the assembly, the center of gravity of the dumbbell is disposed generally in the same vertical plane as are the weight support columns, thereby helping to stabilize the attachment. This feature allows an alternate embodiment of the attachment to be used safely in combination with free-standing weight support columns.

6 Claims, 6 Drawing Sheets

HORIZONTALLY EXTENDIBLE DUMBBELL SUPPORT ATTACHMENT FOR WEIGHT LIFTING BENCH

This application is a continuation-in-part of Ser. No. 08/829,331, filed Mar. 31, 1997.

BACKGROUND OF THE INVENTION

This invention relates in general to exercise equipment and in particular to dumbbells for use while exercising. In the applicant's previous teachings, there is disclosed an attachment which can be supported by a pair of vertical support columns commonly found in a standard weight-lifting bench. Used to support at least one dumbbell, this attachment works well with vertical support columns which are spaced apart from each other by a distance which matches the fixed span of the attachment. Needless to say, it does not fit all benches. Morever, the vertical mounting legs in this prior art attachment are situated rearwardly of its dumbbell holders as well as of the center of gravity of any dumbbell weights resting therein, thus generally limiting the use of the attachment to situations in which it can be mounted upon vertical support columns secured to a bench rather than upon free-standing columns.

SUMMARY OF THE INVENTION

The object of the present invention is to provide a dumbbell support rack attachment which not only can be safely used to handle even the heaviest dumbbells but which can also be readily adjusted for use with a wide variety of weight lifting benches including those in which the spacing between the weight support columns therein differs substantially from that of other benches.

An additional object of the present invention is to provide a dumbbell support rack attachment having an adjustable span which can be used with weight support columns which are spaced apart from each other by a distance which is anywhere within the range of 34 inches to 54 inches.

A further object of the present invention is to provide a dumbbell support rack attachment for a pair of weight support columns having a rack assembly with at least one dumbbell holder in which the center of gravity of any dumbbell weight resting therein is disposed generally in the same vertical plane as are the weight support columns, thereby virtually eliminating any tendency of the rack assembly to rotate relative to the support columns when a dumbbell weight is placed within the dumbbell holder.

The dumbbell support attachment according to the present invention includes a grooved rack assembly having a pair of horizontal support bars, a pair of dumbbell holders rigidly attached thereto, an extension bar which in use is slideably inserted into opposing ends of the horizontal support bars, and a pair of vertical mounting legs. The mounting legs, which are spaced apart from each other, are fixedly connected to portions of the dumbbell holders which are disposed proximate with distal ends of the rack assembly.

Below points of attachment to its contiguous horizontal support bar, each dumbbell holder defines, in transverse cross-section, a "J"-shaped structure. The lower portion of this structure includes two branches, each of which opens upwardly and has a curved inner surface with a radius of curvature which is larger than that of the outer periphery of the heaviest dumbbell weight to be used.

Separated from each other by a distance which is shorter than the cross bar of the dumbbell in length, contiguous branches within each dumbbell holder define a cutout which is wide enough to allow a person to easily put his hand therethrough. In use, any dumbbell resting in the holder is positioned in such a way that the cross bar of the dumbbell is directly above the cutout. Thus, an athlete, as he lies on the weightlifting bench, can reach through the cutout to grab the cross bar of any such dumbbell and lift it.

Means for adjusting the height of the attachment relative to the bench, according to a user's preference, includes each of the vertical mounting legs having a series of holes longitudinally spaced apart from each other and a pair of removable pins, each pin being engageable with a pair of openings in one of the weight support columns of the bench, so that the vertical mounting legs can be held within the columns at one of a several different heights relative to the bench.

DETAILED DESCRIPTION OF THE PREFERRED EMBODIMENT

Figure 1:
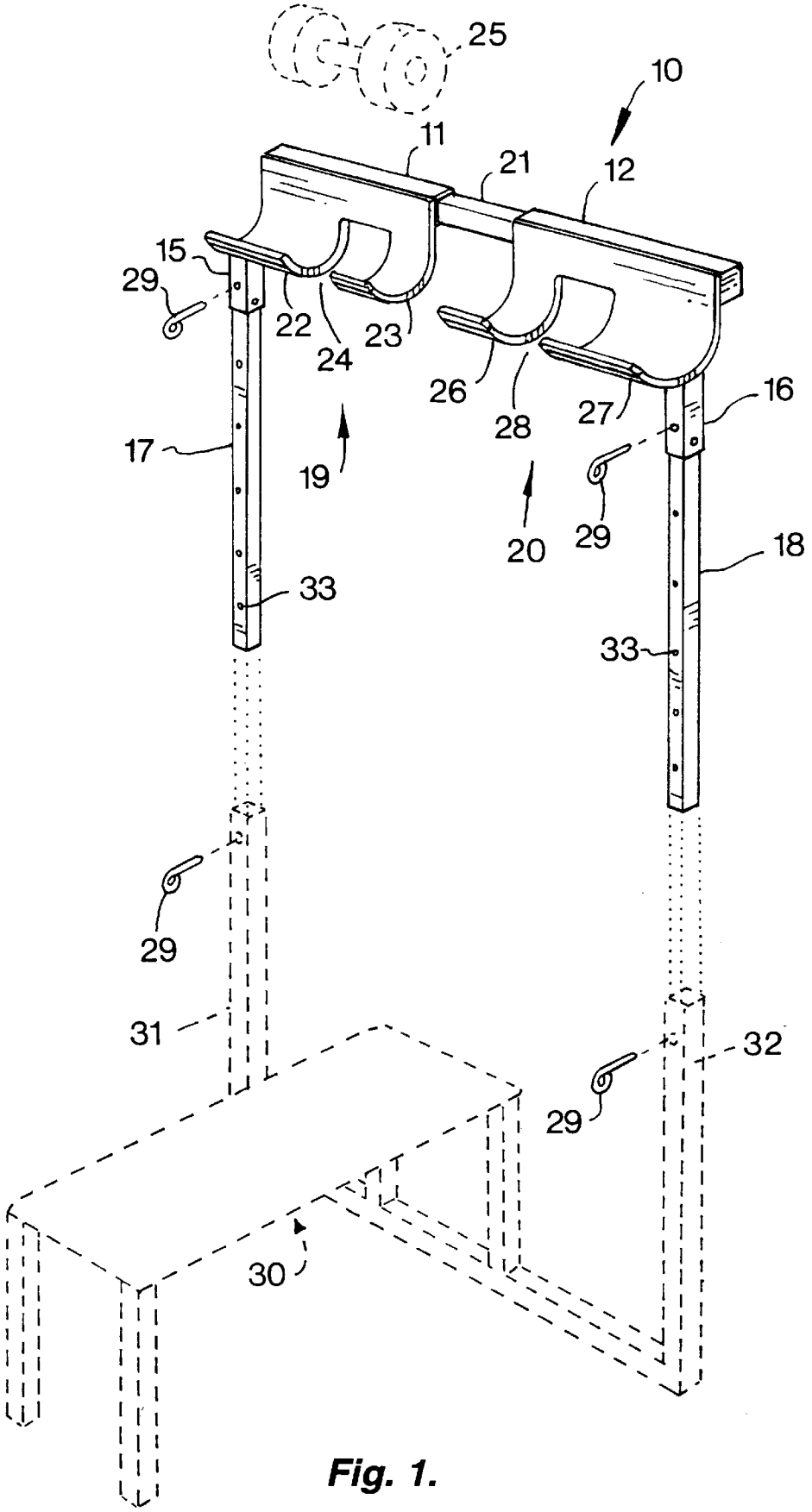
FIG. 1 is a perspective view of the dumbbell support attachment according to the present invention, the attachment being shown in position to be inserted into the tubular support columns of a weight lifting bench, the columns, dumbbell, and bench being shown in dashed lines for illustrative purposes only.
Figure 2:
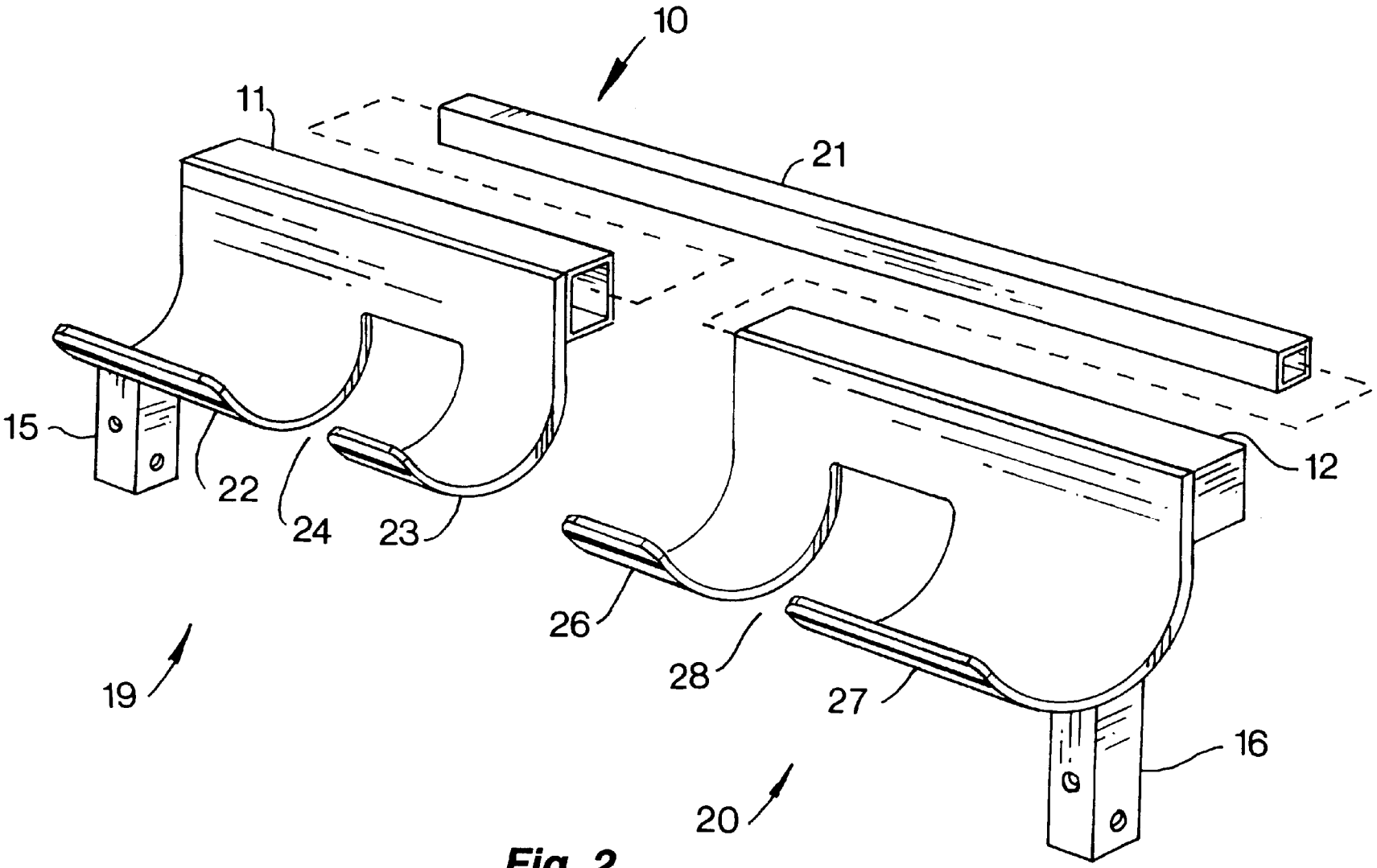
FIG. 2 is an exploded perspective view, on an enlarged scale, of the rack assembly in the attachment according to FIG. 1, the rack assembly being shown prior to its extension bar being slideably inserted into opposing ends of the paired horizontal support bars.

Referring to the drawing, a dumbbell support attachment indicated generally by the reference numeral 10 is provided for supporting up to two dumbbells 25. The attachment 10, fabricated of metal and intended to be used with a weight lifting bench 30 having two vertically-disposed tubular members 31, 32, comprises a grooved rack assembly having a pair of horizontal support bars 11, 12, dumbbell holders 19, 20 rigidly attached thereto, and an extension bar 21 interconnecting the support bars (FIG. 1). In addition, mounting legs 15, 16 are rigidly attached to holders 19, 20 at the distal ends of the rack assembly and the extension bar 21 is slideably interconnected with the support bars 11, 12 which are situated in opposing parts of this assembly. Utilizing the extension bar 21, one can adjust the span between the mounting legs 15, 16 and align them with the weight support columns of a weight lifting bench, even though the spacing between its columns may differ substantially from that of other models with which the attachment 10 can also be used.

Figure 3:
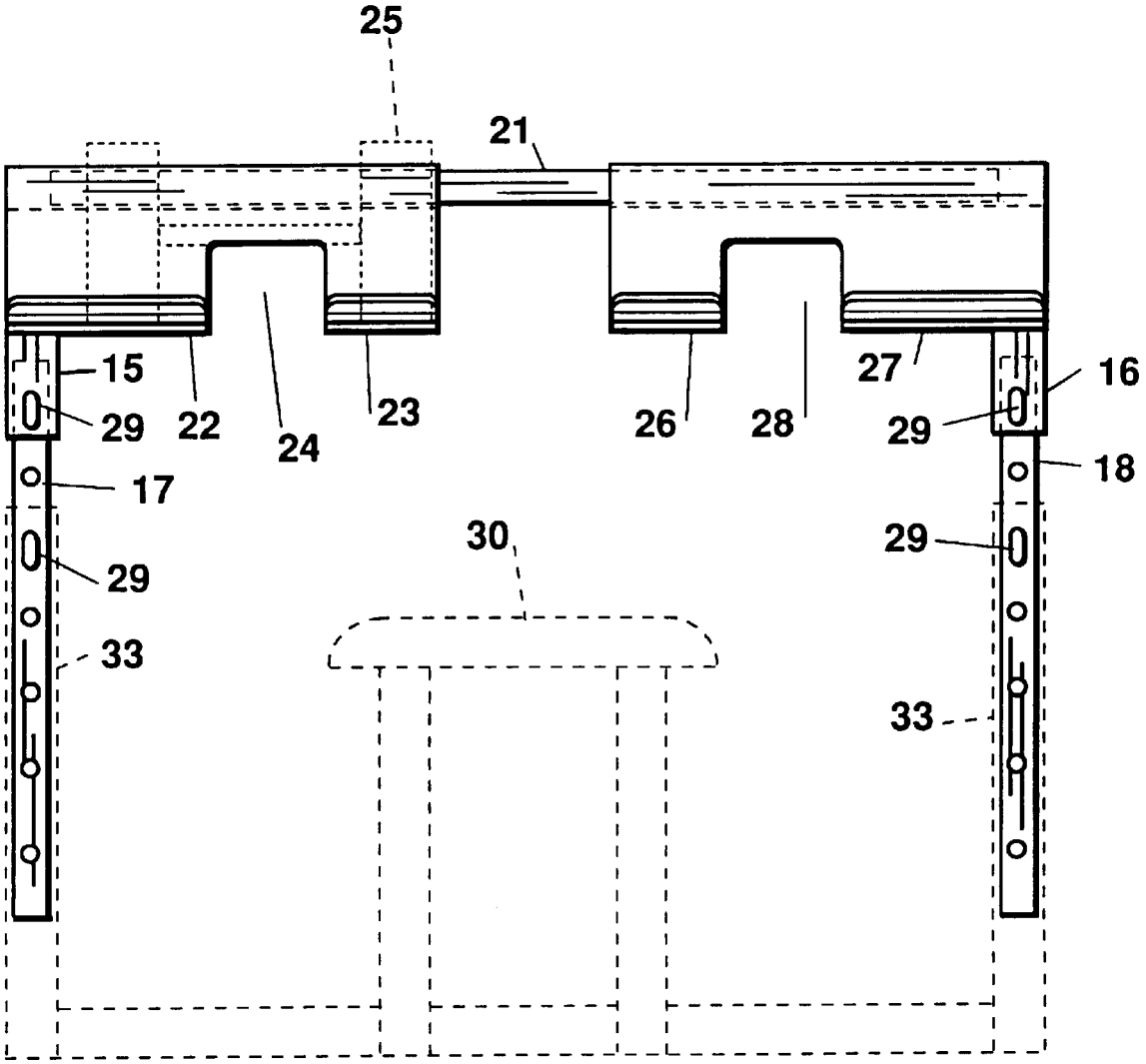
FIG. 3 is a front elevational view, on a less enlarged scale, of the attachment according to FIG. 1, those portions of the extension bar disposed within the horizontal support bars being illustrated in dashed lines as are the columns, dumbbell, and bench.
Figure 4:
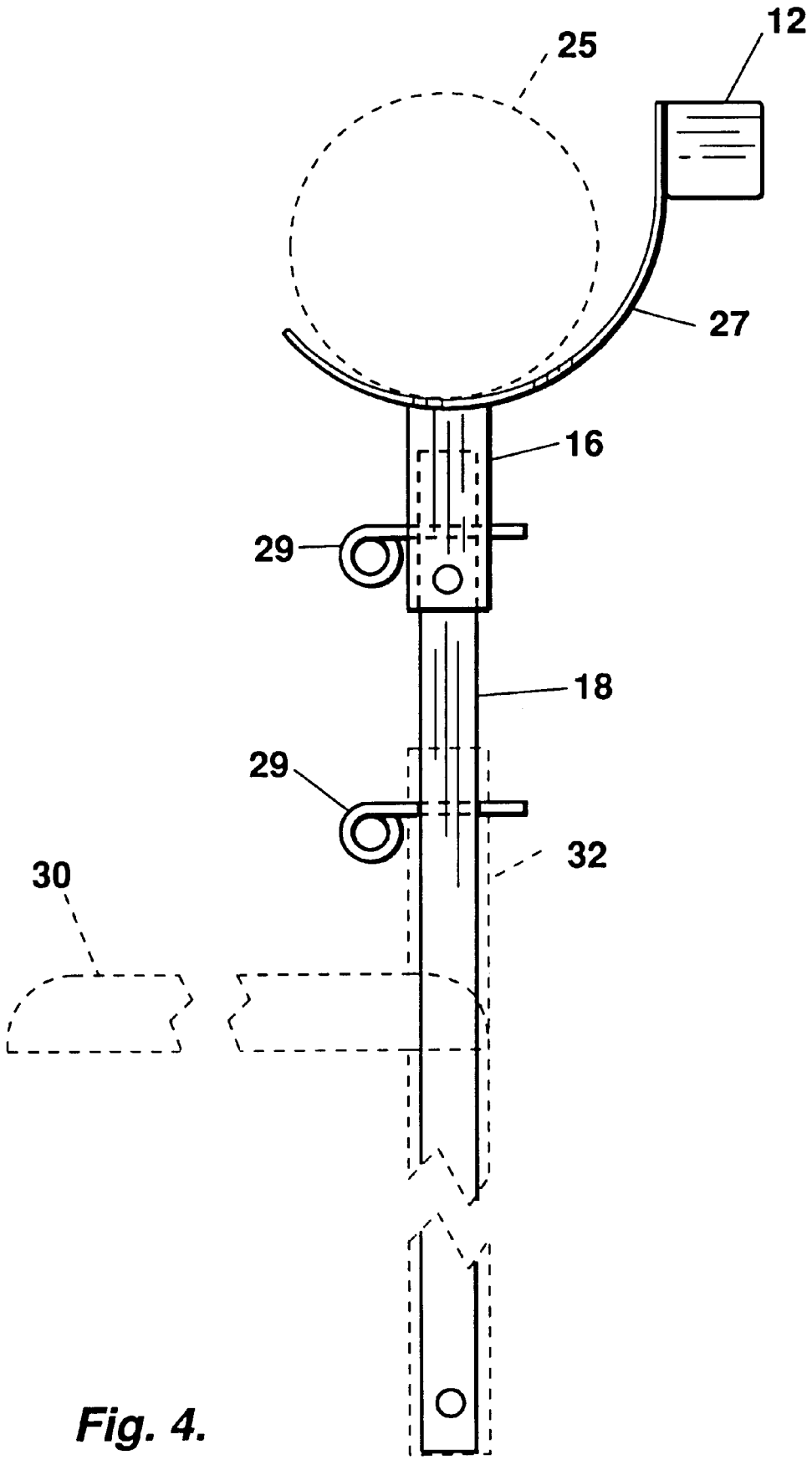
FIG. 4 is a right side elevation view on an enlarged scale of the attachment according to FIG. 1, only fragmentary portions of one of its vertical mounting legs being shown for ease of illustration.

As is seen in FIGS. 3 and 4, each of the dumbbell holders 19, 20 defines a structure on which one can rest a dumbbell 25. Viewed from the side or, alternately, in transverse cross-section, the structure resembles a "J" having a lower portion which is disposed along a generally semicircular curve. In the preferred embodiment, this semicircular curve has, by way of example, a radius of curvature of about 6 inches.

Viewed in elevation from the foot of the bench 30, each holder 19, 20 is seen to be segmented in two branches 22 and 23, 26 and 27, respectively, and defines an open cutout 24, 28 (FIG. 3). In the assembled attachment 10, each cutout 24, 28 is spaced apart from the other longitudinally and has a width which is similar to but shorter in length than the cross bar of the dumbbell 25 (FIG. 3). Measuring, by way of example, about 6 inches in width, the cutouts 24, 28 extend about 8 inches in a direction transverse to the horizontal support bars 11, 12.

When mounted on a popular model of the weight lifting bench 30, the attachment 10 measures, by way of example, about 48 inches in length. In such a case, the cutouts 24, 28 are then preferably spaced apart from each other about 24 inches; and a view port, measuring about 17 inches in length, is created between proximate edges of the branches 23, 26, giving a user an opportunity to view the dumbbells 25 as he places them in the rack assembly or, alternately, removes them therefrom.

As shown in FIGS. 1 and 4, the vertical mounting legs 15, 16 are rigidly attached to the branches 22, 27 proximate with the lowermost points thereon and with the distal edges of these branches. In use, the leg extensions 17, 18, with their upper ends inserted into the mounting legs 15, 16 and rigidly attached thereto, provide means for mounting the rack assembly on the tubular members 31, 32 (FIG. 1). Specifically, to hold the mounting leg 15, 16 and leg extension 17, 18, respectively, in assembled relation, each mounting leg has a pair of holes formed therein, through which a pin 29, engageable with an opening formed in the leg extension can be inserted (FIG. 4).

Moreover, the outer dimensions of each leg extension 17, 18, in transverse cross-section, are sufficiently small relative to the inner dimensions of the vertical mounting legs 15, 16 that the leg extensions are slideably receivable by the mounting legs (FIGS. 1, 3 and 4). In the preferred embodiment, the legs 15, 16 are fabricated from 2 inch square tubing; and the leg extensions 17, 18 from 1-¾ inch square tubing. Since weight support columns 31, 32 are also commonly fabricated from 2 inch square tubing and have approximately the same transverse cross-section as do the mounting legs 15, 16, such weight support columns can slideably receive the leg extensions 17, 18 of the preferred embodiment.

In order to allow the user to adjust the height of the attachment 10 above the bench 30, each of the leg extensions 17, 18 defines a plurality of longitudinally spaced apart holes 33 formed therein, through which a pin 29, engageable with a pair of openings formed in each of the vertically-disposed tubular members 31, 32, can be inserted to hold the leg extension and tubular member in assembled relation. In use, a pair of pins 29 engage holes formed in the tubular members 31, 32 which in turn are aligned with openings in the leg extension members 17, 18, respectively. Thus, the height of the attachment 10 can be altered to suit the user by making adjustments similar to those which are commonly performed to adjust the heights of barbell supports.

The attachment 10 can be used to hold either one dumbbell 25 or two dumbbells simultaneously. In use, each dumbbell 25 is placed in the holders 19, 20 in such a way that the crossbar of the dumbbell is located directly above one of the cutouts 24, 28. During exercise, an athlete sitting or lying on the bench 30 reaches through the appropriate cutout 24, 28 and lifts the dumbbell 25 off of the holders 19, 20. At the completion of his exercise routine, the athlete, inserting his hand through an unused cutout 24, 28, then returns each dumbbell 25 to the holders 19, 20.

Figure 5:
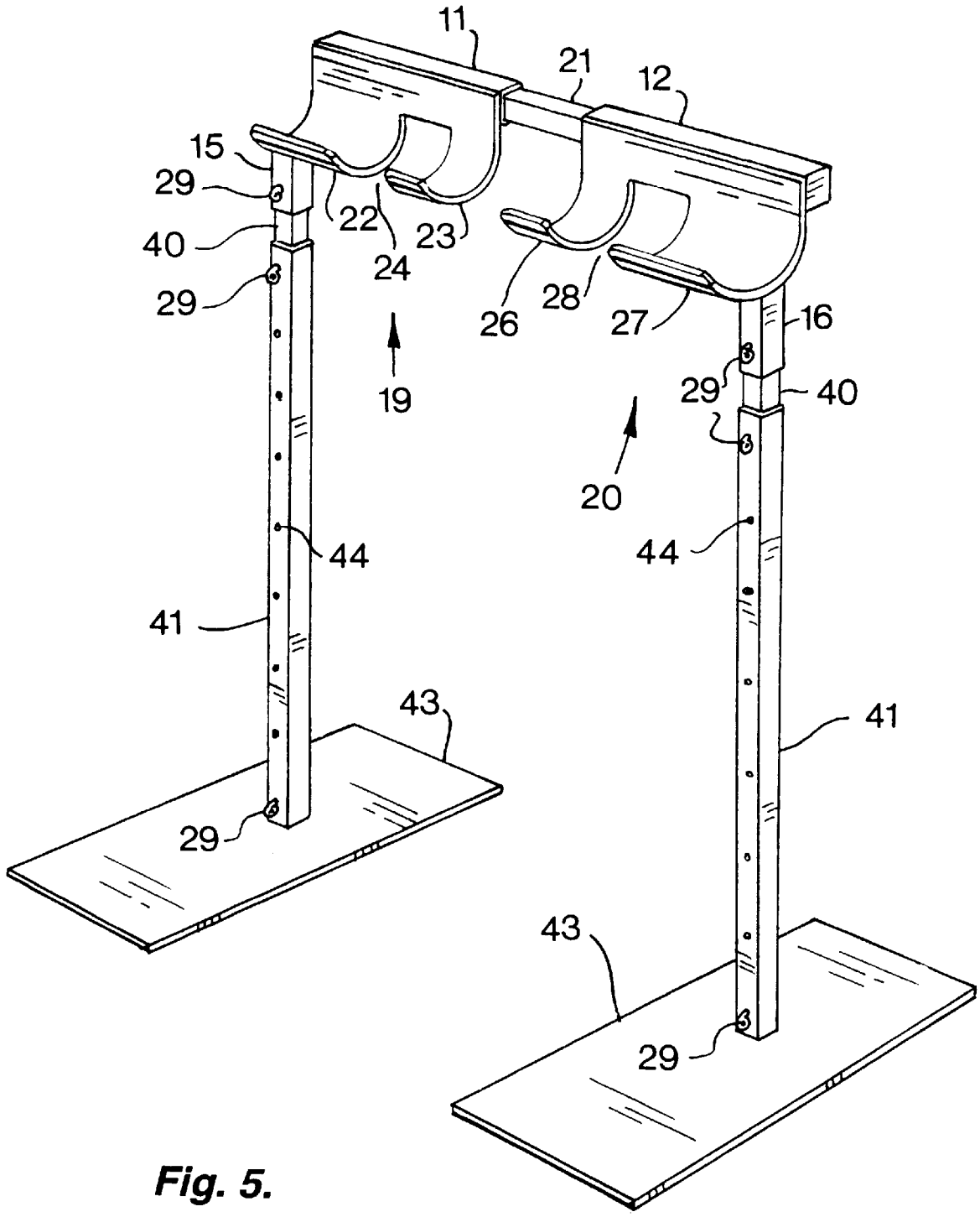
FIG. 5 is a perspective view of an alternate embodiment of the dumbbell rack attachment for use with vertical support columns which are free-standing.
Figure 6:
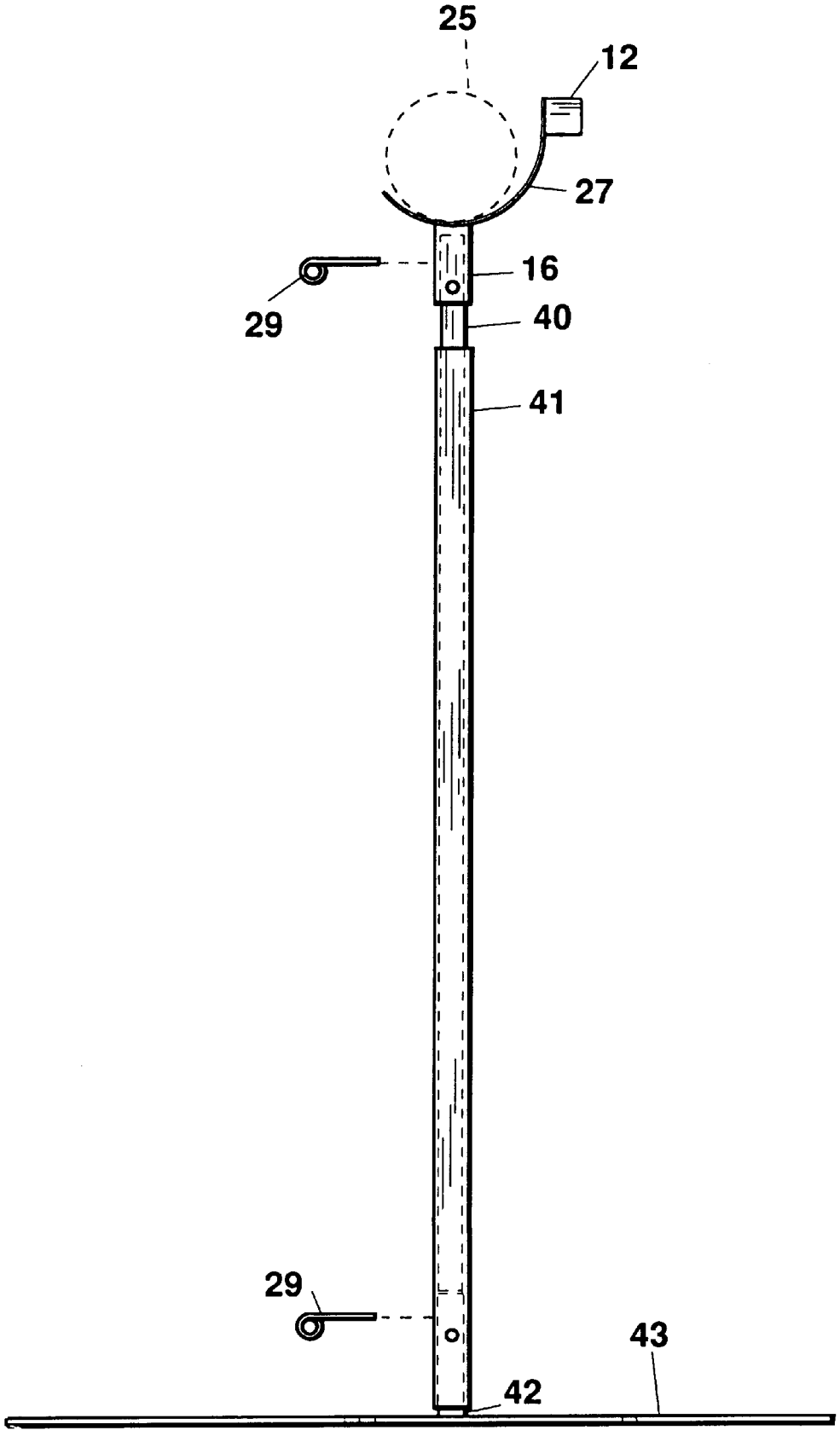
FIG. 6 is a right side elevation view, on an enlarged scale, of the alternate embodiment according to FIG. 5.

In an alternate embodiment, the rack assembly of the attachment 10 is used in combination with a pair of free-standing weight support columns 41 (FIGS. 5 and 6). Means for rigidly attaching the rack assembly to the columns 41 includes a pair of leg extensions 40. Similarly to the leg extensions 15, 16, the upper ends of extensions 40 are slideably insertable into the mounting legs 15, 16 and the lower ends of these extensions can be slip fitted into the columns 41. The latter are themselves slip fitted over base extensions 42 which are rigidly attached to base plates 43 (FIG. 6). Pins 29 are used to hold the mounting legs 15, 16 and leg extensions 40; leg extensions and weight support columns 41; and columns and base extensions 42 in assembled relation (FIGS. 5 and 6). A series of pairs of holes 44 formed in each column 41 and spaced apart longitudinally are provided so that the user can adjust the attachment 10 so that it is located at a desired height above the bases 43.

It is understood that those skilled in the art may conceive other applications, modifications and/or changes in the invention described above. Any such applications, modifications or changes which fall within the purview of the description are intended to be illustrative and not intended to be limitative. The scope of the invention is limited only by the scope of the claims appended hereto.

It is claimed:

1. A support for a dumbbell having a pair of weights spaced apart from each other and mounted on a cross bar, the support being adapted for use with a weight lifting bench having two vertically-disposed tubular members between which the bench is disposed, comprising:

(a) a grooved rack assembly including first and second elongated horizontal support bars which are spaced apart from each other;

(b) means, including an extension bar which can be slideably received by the horizontal support bars, for adjusting spacing between the horizontal support bars, the extension bar being aligned longitudinally with both horizontal support bars when the extension bar is slideably received by said support bars;

(c) the grooved rack assembly having first and second structures rigidly attached to the first and second horizontal support bars, respectively; each structure defining a pair of branches, the branches of the first structure extending away from points of attachment between the first structure and the first horizontal support bar, the branches of the second structure extending away from points of attachment between the second structure and the second horizontal support bar, the branches in each of the structures being separated from each other by a distance which is shorter than the cross bar of the dumbbell in length but which is sufficiently long to permit insertion of a hand between the branches to allow for a person to manipulate the dumbbell; and (d) means, rigidly attachable to the two tubular members, for mounting the grooved rack assembly, the mounting means including first and second vertical mounting legs rigidly attached to the first and second structures, respectively; the mounting legs being alignable vertically with proximate tubular members.

2. The support according to claim 1 wherein the grooved rack assembly further defines a view port which is disposed between the first and second structures.

3. The support according to claim 1 wherein the mounting means further comprises a pair of leg extensions, upper and lower portions of each leg extension being slideably insertable into one of the vertical mounting legs and into one of the vertically-disposed tubular members, respectively.

4. A support for a dumbbell having a pair of weights spaced apart from each other and mounted on a cross bar, the support being adapted for use with a weight lifting bench having two vertically-disposed tubular members between which the bench is disposed, comprising:

(a) a grooved rack assembly including first and second elongated horizontal support bars which are spaced apart from each other;

(b) means, including an extension bar which can be slideably received by the horizontal support bars, for adjusting spacing between the horizontal support bars, the extension bar being aligned longitudinally with both horizontal support bars when the extension bar is slideably received by said support bars;

(c) the grooved rack assembly having first and second structures rigidly attached to the first and second horizontal support bars, respectively; each structure defining a pair of branches, the branches of the first structure being disposed downwardly of points of attachment between the first structure and the first horizontal support bar, the branches of the second structure being disposed downwardly of points of attachment between the second structure and the second horizontal support bar, the branches in each of the structures being separated from each other by a distance which is shorter than the cross bar of the dumbbell in length but which is sufficiently long to permit insertion of a hand between the branches to allow for a person to manipulate the dumbbell; and (d) means, rigidly attachable to the two tubular members, for mounting the grooved rack assembly, the mounting means including first and second vertical mounting legs rigidly attached to the first and second structures, respectively; the mounting legs being alignable vertically with proximate tubular members.

5. A support for a dumbbell having a pair of weights spaced apart from each other and mounted on a cross bar, the support being adapted for use with two free-standing, vertically-disposed tubular members which have approximately equivalent transverse cross-sections and overall length, comprising:

(a) a grooved rack assembly including first and second elongated horizontal support bars which are spaced apart from each other;

(b) means, including an extension bar which is slideably received by the horizontal support bars, for adjusting spacing between the horizontal support bars, the extension bar being aligned longitudinally with both horizontal support bars;

(c) the grooved rack assembly having first and second structures rigidly attached to the first and second horizontal support bars, respectively, each of the structures having a pair of branches which are separated from each other by a distance which is shorter than the cross bar of the dumbbell in length but which is sufficiently long to permit insertion of a hand between the branches to allow for a person to manipulate the dumbbell; and (d) means, rigidly attachable to the two tubular members, for mounting the grooved rack assembly, the mounting means including first and second mounting legs rigidly attached to the first and second structures, respectively, the mounting legs being alignable vertically with the tubular members.

6. The support according to claim 5 in which the pair of branches in the first structure are disposed downwardly of points of attachment between the first structure and the first horizontal support bar and the pair of branches in the second structure are disposed downwardly of points of attachment between the second structure and the second horizontal support bar.

* * * * *